United States Patent [19]

Moroney

[11] Patent Number: 4,827,753

[45] Date of Patent: May 9, 1989

[54] EXTRUSION FORMER WITH THREE-WAY POWERED MOVEMENT

[75] Inventor: Edward E. Moroney, Matthews, N.C.

[73] Assignee: The Cyril Bath Company, Monroe, N.C.

[21] Appl. No.: 5,213

[22] Filed: Jan. 20, 1987

[51] Int. Cl.[4] ..... B21D 11/02

[52] U.S. Cl. ..... 72/296; 72/297; 72/299; 72/302; 72/306; 72/371

[58] Field of Search ..... 72/57, 60, 62, 295, 72/296, 297, 299, 302, 306, 305, 371

[56] References Cited

U.S. PATENT DOCUMENTS 3,757,557 9/1973 Kost ..... 72/302
4,698,995 10/1987 Chorneau ..... 72/302

FOREIGN PATENT DOCUMENTS 212814 12/1983 Japan ..... 72/389

*Primary Examiner*—David Jones

*Attorney, Agent, or Firm*—W. Thad Adams, III

[57] ABSTRACT

An elongate member former is characterized by three-way powered forming movement and is composed of a main frame and a moveable die table mounted on the main frame and adapted to carry a die for being urged against the member to form the member into a predetermined shape. Carriage ways are carried on the main frame and first and second carriages mounted are on the carriage ways in spaced-apart relation on opposing sides of the die table. Member holders are carried by each of the first and second carriages for holding opposite ends of a member to be formed. Tensioners are carried by each of the first and second carriages for placing the member being formed under a predetermined tension. The first and second carriages rotate for applying a twisting forming movement to the member and the first and second carriages move the member holders vertically along a line perpendicular to the direction of tension application on the member for applying a nontwisting bend to the member.

2 Claims, 18 Drawing Sheets

STEP (3) INSERTING MANDRELS

EXTRUSION FORMER WITH THREE-WAY POWERED MOVEMENT

TECHNICAL FIELD AND BACKGROUND OF INVENTION

This invention relates to an extrusion former having threeway powered forming movement. The invention is useful for forming members, including tubular members, into complex, asymmetrical shapes as well as simpler, more conventional ones. The particular disclosure of this application is of a former intended to form extrusions into various shapes. The ability of the extrusion to be formed without crimping is enhanced both by placing the extrusion under tension to a point within the yield state of the extrusion and then "inflating" the extrusion with high pressure air to provide greater pressure resistance to the extrusion during the forming process.

Simple shapes can be formed into elongate members formed of a material such as steel or aluminum simply by holding the opposing ends of the member and then urging a die against the member. This procedure has been carried out in the past but is limited in its application. The present invention greatly increases the utility of forming as a means of metal fabrication in many industries such as automobile and aircraft manufacturers where complex asymmetrical shapes have been heretofore formed in a series of discrete steps on different machines or avoided altogether.

SUMMARY OF THE INVENTION

Therefore, it is an object of the invention to provide an elongate member former characterized by three-way powered movement. The former comprises a main frame on which is mounted a moveable die table adapted to carry a die for being urged against a member to form the member into a predetermined shape.

Carriage ways are carried on the main frame and mount first and second carriages in spaced-apart relation on opposite sides of the die table.

Member holding means are carried by each of the first and second carriages for holding opposite ends of the member to be formed. Tensioning means are carried by each of the first and second carriages for placing the member being formed under a predetermined tension.

Rotation means are carried by each of the first and second carriages for applying a twisting forming movement to the member.

Vertical movement means are carried by each of said first and second carriages for moving the member holding means vertically along a line perpendicular to the direction of tension application of the member for applying a nontwisting bend to the member. Control means control the movement of the tensioning means, rotation means and vertical movement means to achieve a member conforming to a predetermined configuration.

Preferably, the vertical movement means comprises a top cylinder and a mating top piston carried by the carriage and a bottom cylinder and a mating bottom piston carried by the carriage, and the control means includes hydraulic fluid means for simultaneously increasing pressure in the top cylinder and decreasing pressure in the bottom cylinder to lower the extrusion holding means and for simultaneously decreasing pressure in the top cylinder and increasing pressure in the bottom cylinder to raise the extrusion holding means.

BRIEF DESCRIPTION OF THE DRAWINGS

The invention will now be described more fully with reference to the following drawings in which:

FIGS. 12-1 through 12-3 depicts a hydraulic circuit diagram of the extrusion former;

DETAILED DESCRIPTION OF THE PREFERRED EMBODIMENT

Figure 1:
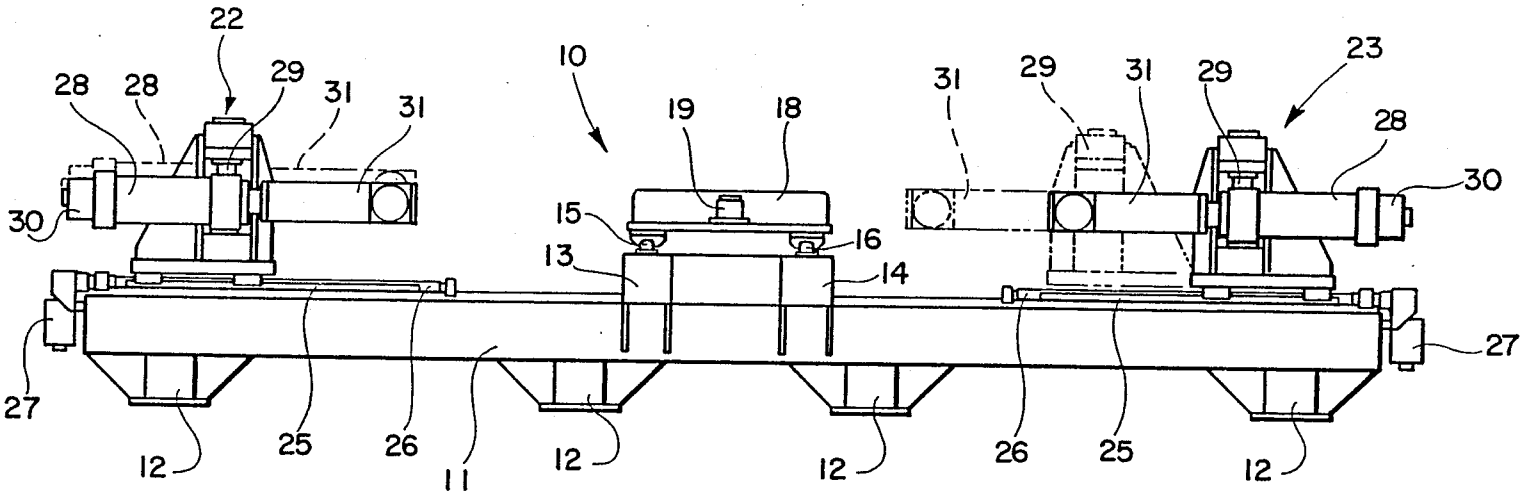
FIG. 1 is a front elevation of an extrusion former according to the present invention.
Figure 2:
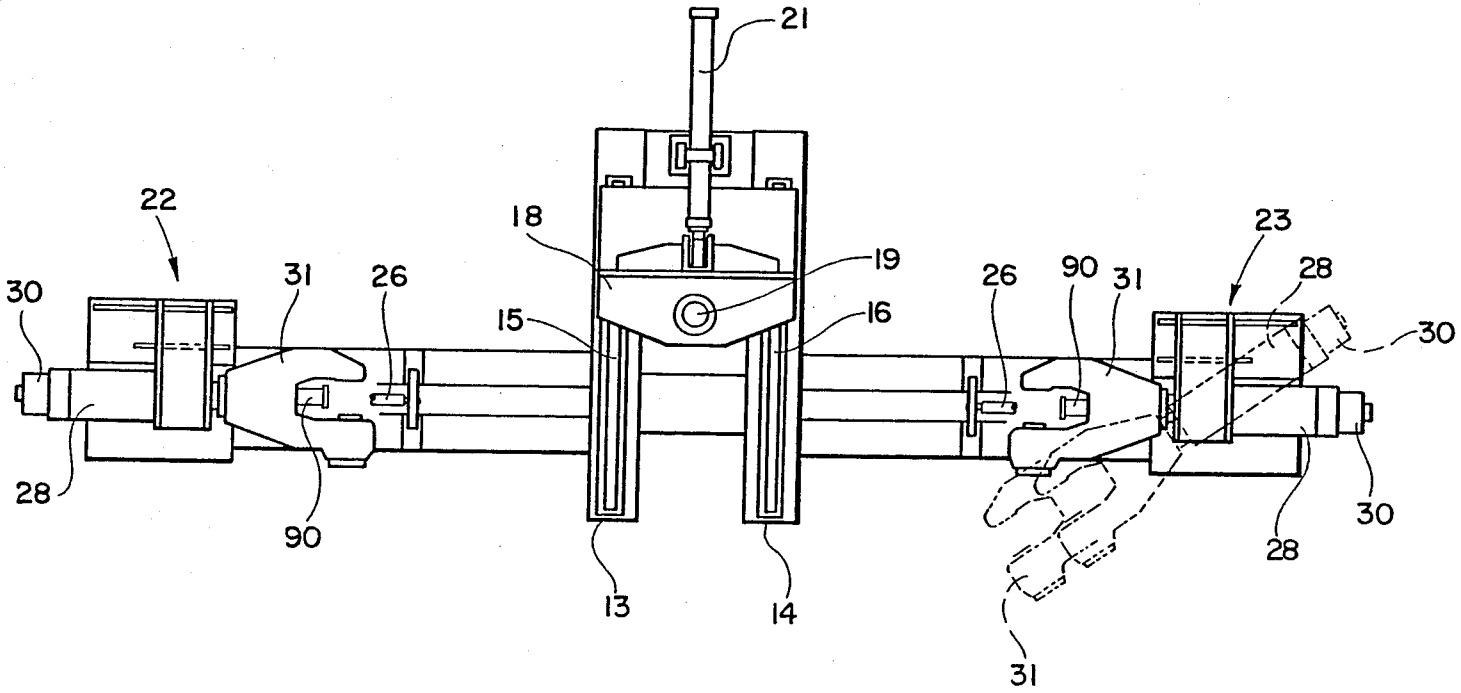
FIG. 2 is a top plan view of the stretch former shown in FIG. 1.

Referring now specifically to the drawings, an extrusion former according to the present invention is broadly designated at reference numeral 10 and illustrated in FIGS. 1 and 2. The detailed description of the extrusion former and its operation will proceed in the following manner. First, the construction and assembly of the extrusion former will be described with reference to FIGS. 1 through 13. Then, a sequential description of the extrusion forming process carried out by the extrusion former will be described.

Extrusion former 10 comprises a main frame 11 which rests on several spaced-apart reinforced supports 12. Frame 11 is constructed of reinforced steel and supports the main operating components of extrusion former 10. A pair of spaced-apart perpendicularly extending rails 13 and 14 are positioned in the center of frame 11. A pair of antifriction ways 15 and 16 are positioned on rails 13 and 14, respectively, and support a die table 18 thereon. Die table 18 is thus able to move back and forth along ways 15 and 16 perpendicular to the longitudinal extent of frame 11. A die mounting post 19 is positioned on die table 18 and is adapted to receive a suitably constructed die 20. (See FIGS. 13 through 18). The die 20 is shaped so that a proper shape is imparted to the extrusion as it is bent around the forward edge of the die.

As is best shown in FIG. 2, die table 18 is moved along ways 15 and 16 by a die table cylinder 21.

Referring again to FIG. 1, a left hand carriage 22 and a right hand carriage 23 are mounted on opposing ends of frame 11. The operation of left hand carriage 22 and right hand carriage 23 is the same. Therefore, further detailed description of carriages 22 and 23 will be with reference only to carriage 23, it being understood that the description and the reference numerals apply equally to left hand carriage 22.

Carriage 23 is mounted for movement along frame 11 on carriage ways 25. Movement of carriage 23 on ways 25 is effected by means of a screw drive 26 which is activated by a carriage drive motor 27. Carriage 23 carries a tension cylinder 28. Tension cylinder 28 is moved vertically on carriage 23 by a vertical shift actuator 29. Tension cylinder 28 is rotated by a rotary actuator 30.

A jaw 31 is secured to one end of tension cylinder 28. An extrusion is formed into its desired shape by placing one end of the extrusion in the respective jaws 31 carried by carriages 22 and 23 and, while thus being held, urging the die 20 on the die table 18 against the central portion of the extrusion. See FIG. 17 below. Jaws 13 and tension cylinders 28 are free to pivot about a vertical axis defined by respective vertical shift actuators 29.

Figure 3:
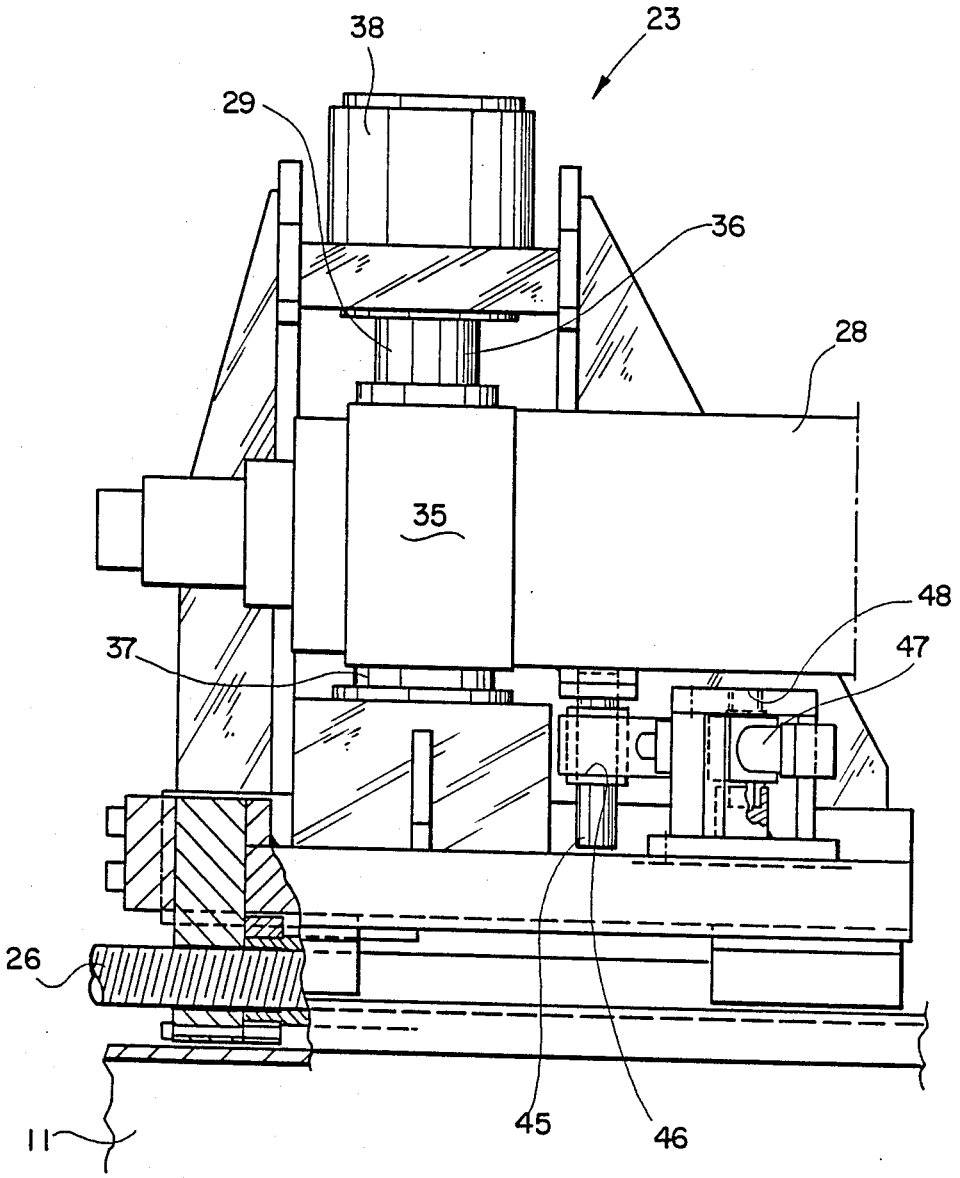
FIG. 3 is an enlarged, fragmentary front elevation view, with parts in cross section of one of the carriages of the stretch former.
Figure 4:
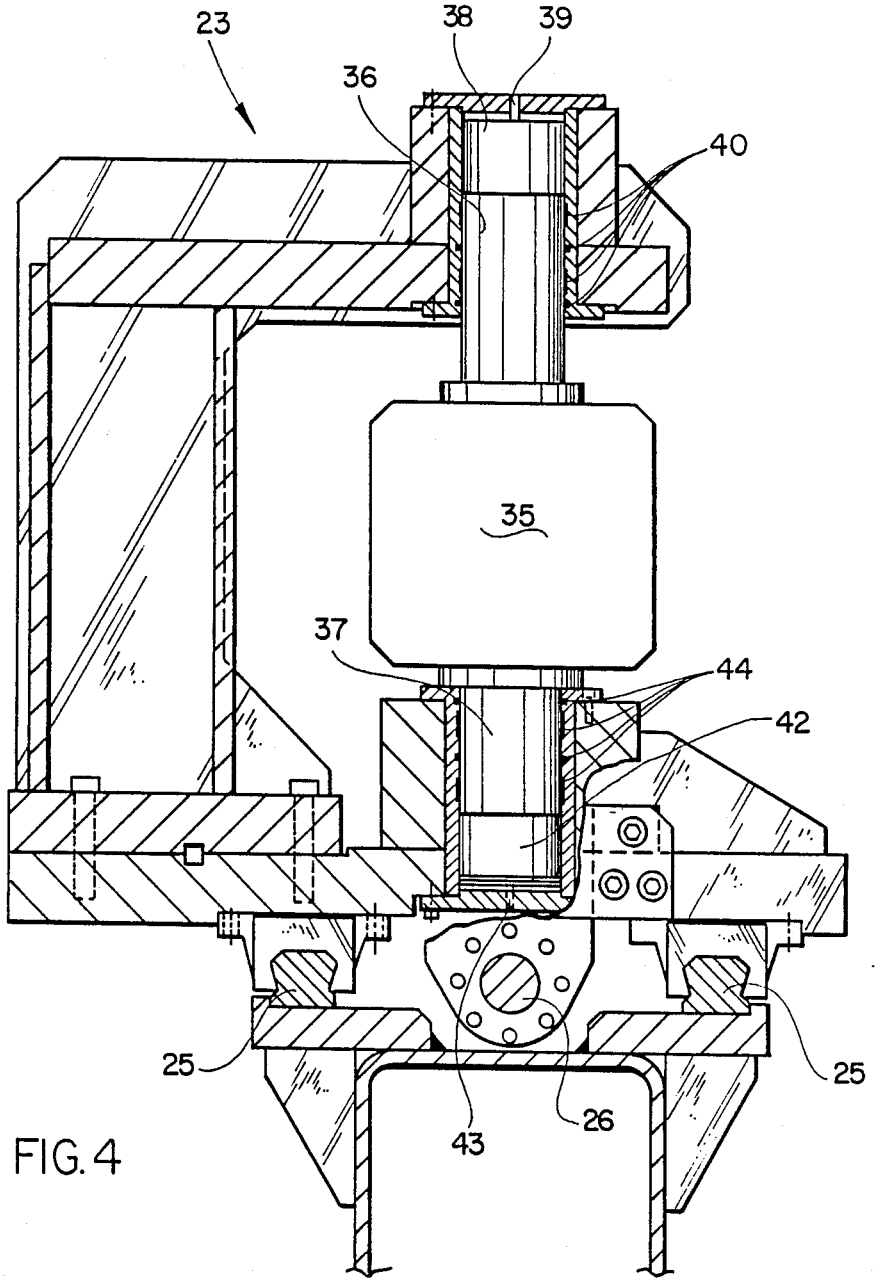
FIG. 4 is an end elevation view, with parts in cross section, of the carriage shown in FIG. 3.

Carriage 23 is shown in more detail in FIGS. 3 and 4. The vertical shift actuator 29 includes a mounting block 35 which carries tension cylinder 28. Mounting block 35 is supported between two cylindrical posts 36 and 37. Post 36 is positioned within a hydraulic cylinder 38. A port 39 permits hydraulic fluid to be introduced into cylinder 38. Several sets of annular seals 40 provide a hydraulic fluid-tight hydraulic fluid chamber.

Post 37 is likewise mounted within a cylinder 42 which includes a hydraulic fluid port 43. A series of annular seals 44 prevent leakage of hydraulic fluid.

By continued reference to FIG. 4, it can now be seen that posts 36 and 37 define hydraulically actuated pistons. When the hydraulic system, described below, pumps hydraulic fluid into cylinder 38 and withdraws fluid from cylinder 42, mounting block 35 and the tension cylinder 28 carried thereon are caused to move downwardly. To lift tension cylinder 28, hydraulic fluid is pumped into cylinder 42 and withdrawn from cylinder 38.

Referring again to FIG. 3, a downwardly extending, vertical slide bar 45 is slidably positioned in a collar 46 of a locking cylinder 47. Locking cylinder 47 is itself pivotally mounted on a vertically extending shaft 48 and follows the motion of tension cylinder 28 as it pivots. Locking cylinder 47 operates in three distinct modes.

During the forming process, locking cylinder 47 is in a "float" mode whereby the cylinder is free to pivot and extend as tension cylinder 28 pivots. When tension cylinder 28 reaches a position where the extrusion being formed has acquired its final, desired shape, the locking cylinder 47 is hydraulically switched into a "locking" mode whereby, through its cooperation with vertical slide 45, tension cylinder 28 is locked into the exact position of pivot assumed as the extrusion acquired its final shape. This permits tension to be released on the extrusion without tension cylinder 28 moving from its final position. This, in turn, prevents binding of the extrusion within the jaws 31.

Figure 5:
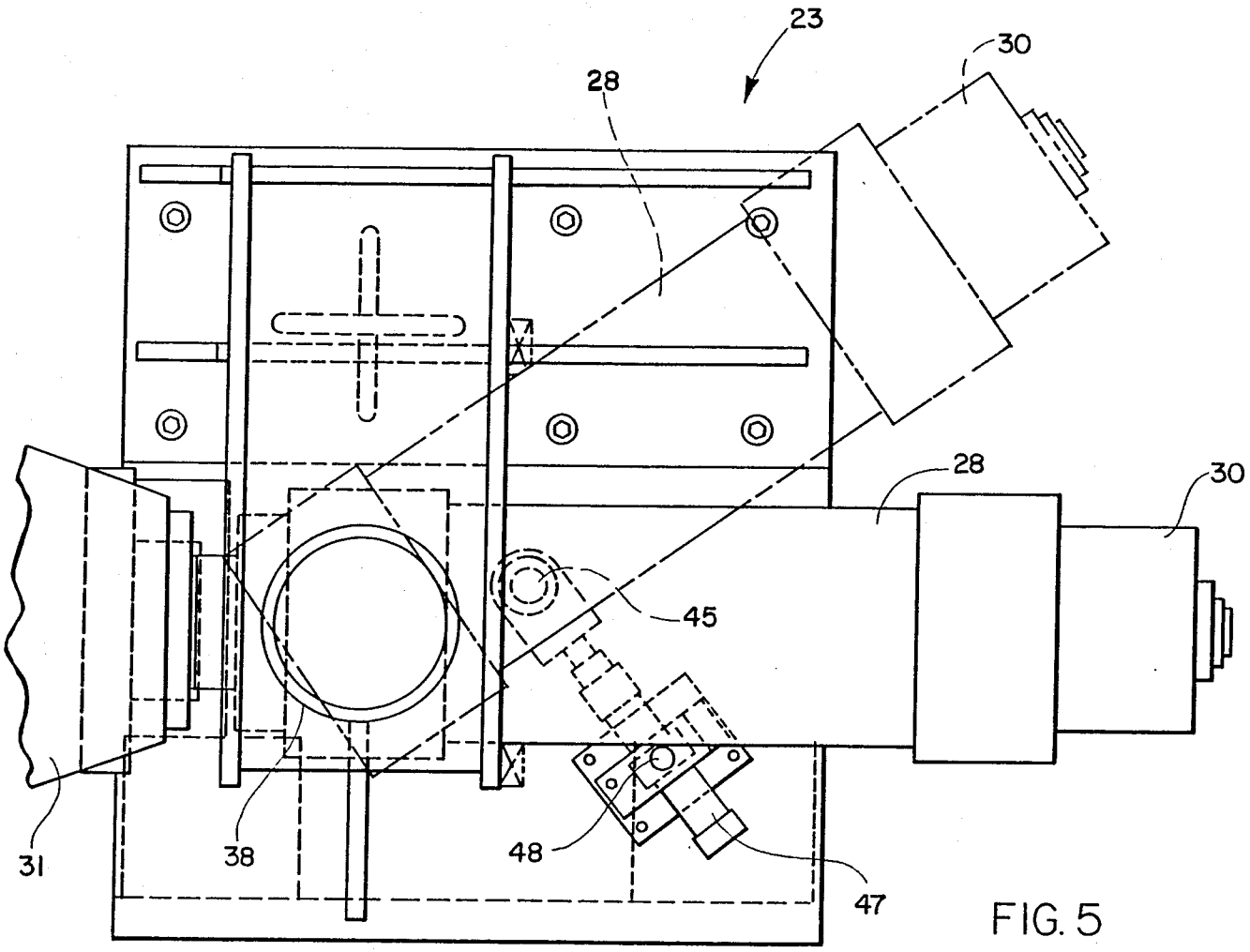
FIG. 5 is a fragmentary top plan view showing operation of the tension cylinder and locking cylinder.

After the extrusion has been removed from jaws 31, locking cylinder 47 assumes a "return" mode whereby it is actuated to return tension cylinder 28 to a starting position essentially parallel with the longitudinal axis of the main frame 11. Tension cylinder 28 has a maximum swing of 35 degrees. This is shown in FIG. 5 which also shows, in plan view, the position and relationship of locking cylinder 47.

Figure 6:
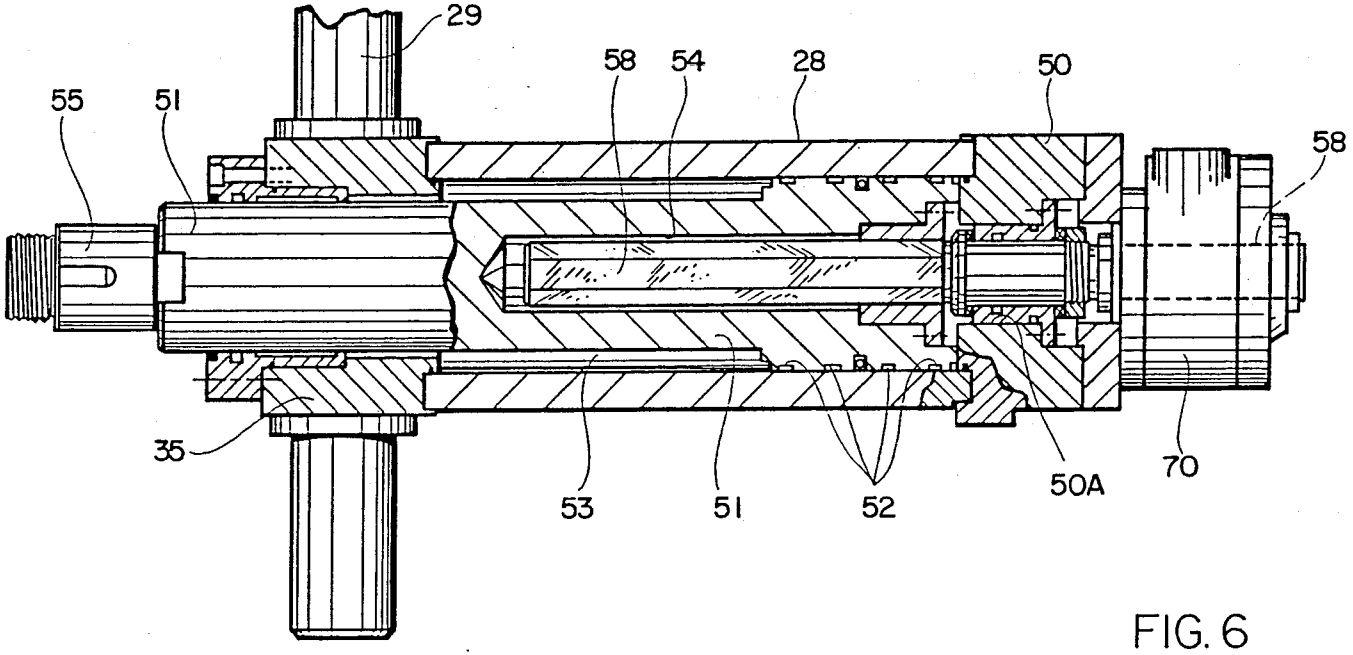
FIG. 6 is a fragmentary vertical cross sectional view showing the construction of the tension cylinder.

The tensioning motion necessary to place the extrusion to be formed within its "yield state" is accomplished by moving tension cylinders 28 on carriages 22 and 23 away from each other slightly. Referring to FIG. 6, the interior structure of one of the tension cylinders 28 is shown. A cylinder head 50 encloses the end of tension cylinder 28. Positioned within tension cylinder 28 is a cylinder rod 51. A plurality of annular seals 52 extending around the enlarged head of rod 51 and defines on the rod end a fluid chamber 53 of variable capacity. Rod 51 includes a centrally disposed, longitudinally extending bore 54 into which is positioned a semi-splined shaft 58. Tension cylinder 28 is fixedly secured to mounting block 35 and cylinder rod 51 extends through mounting block 35 and has a threaded mandrel receiving end piece 55 thereon. Hydraulic fluid supplied to the rod end of tension cylinder 28 urges cylinder rod 51 rearwardly. Pressure transducers monitoring the pressure which is controlled by servo valves. Once the proper position of cylinder rod 51 in tension cylinder 28 has been achieved, the system is balanced on the blind and rod end of tension cylinder 28 in order to maintain cylinder rod 51 in the same position. In FIG. 6, cylinder rod 51 is shown in its rearwardmost position for purposes of clarity. When the extrusion is loaded into the extrusion former, cylinder rod 51 would be substantially forward of the position shown in FIG. 6.

The system can be operated to form by pressure, in which case a specified pressure, for example, 20 tons, (18 metric tons) is maintained on the extrusion. The system can also be used to position form an extrusion by controlling the movement of the tension cylinders 28 by a conventional design linear tracking device. The position is maintained by balancing the total pressure, for example, 3,000 lb/sq in, (2,109,000 kg/sq meter) on the blind and rod end of the tension cylinder 28, as referred to above.

Figure 7:
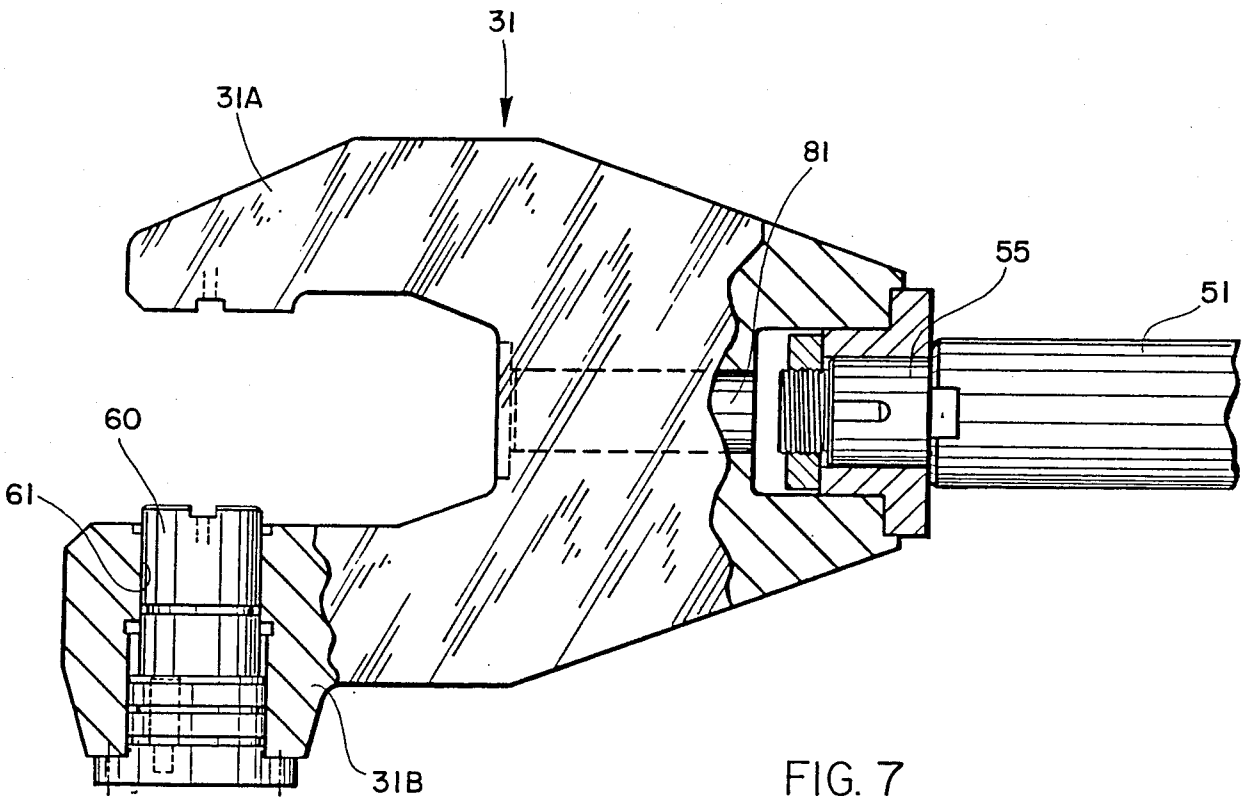
FIG. 7 is a fragmentary cross sectional view of one of the jaws of the extrusion former.

Referring now to FIG. 7, jaw 31 will be explained in further detail. Jaw 31 is mounted on end piece 55 on the end of tension cylinder 28. Jaw 31 has two opposing, spaced-apart jaw members 31A and 31B. Jaw member 31B includes a short stroke hydraulic jaw clamp piston 60 positioned in a suitably formed piston cylinder 61. The extrusion is gripped in jaw 31 by moving piston 60 to its retracted position, substantially as shown in FIG. 7. Once the extrusion is properly in place, piston 60 is extended under low pressure to permit the part to be properly positioned. A mandrel (see below) is inserted, then full pressure is applied and the extrusion is held between jaw members 31A and 31B.

The twisting motion necessary to place a twist in the extrusion is achieved by rotating the cylinder rod 51. This occurs after the extrusion has been placed into its yield state by the divergence of carriages 22 and 23. A hydraulically powered, hollow shaft rotary actuator 70 is mounted on cylinder head 50. Rotary actuator 70 is controlled by a servo device and a potentiometer, which senses the angle of rotation of the rotary actuator. These functions are explained in further detail during the description of the hydraulic circuit with reference to FIG. 13. As is shown in FIG. 6, the semi-splined shaft 58 extends through a bore 50A in cylinder head 50 and through rotary actuator 70. Rotary actuator 70 rotates shaft 58. Since shaft 58 is splined into bore 54, it rotates cylinder rod 51 and end piece 55 on which jaw 31 is mounted. The servo controller controls the rate of fluid flow through the actuator to maintain the speed of rotation and, when the desired angle of twist has been placed in the extrusion, to maintain the actuator in a stationary state at the correct angle until the extrusion forming process is complete.

Figure 8:
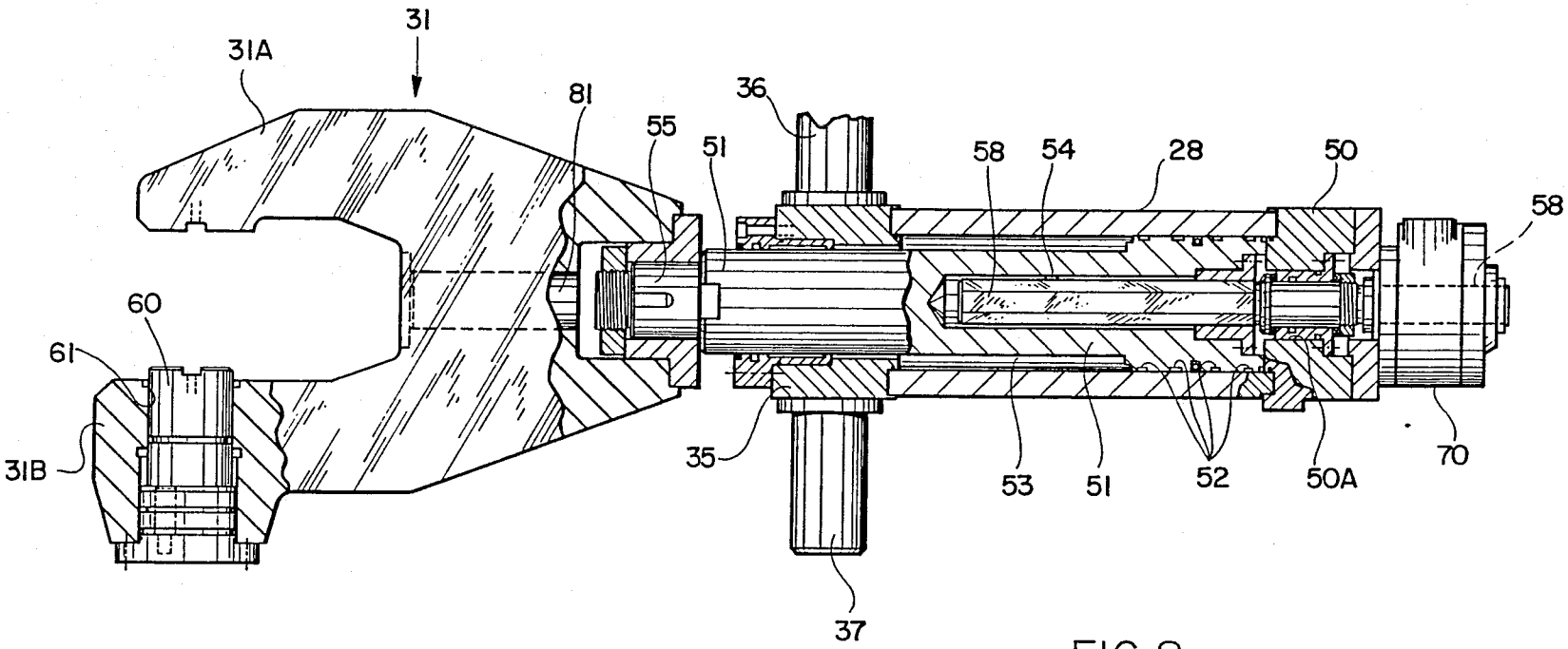
FIG. 8 is a fragmentary vertical partially cross sectional view of the tension cylinder shown in FIG. 6 and the jaw shown in FIG. 7, respectively.

A more complete view of the fragmentary elements of carriage 23 which have been described with reference to FIGS. 5, 6 and 7 are shown, in a unitary view, in FIG. 8.

Figure 9:
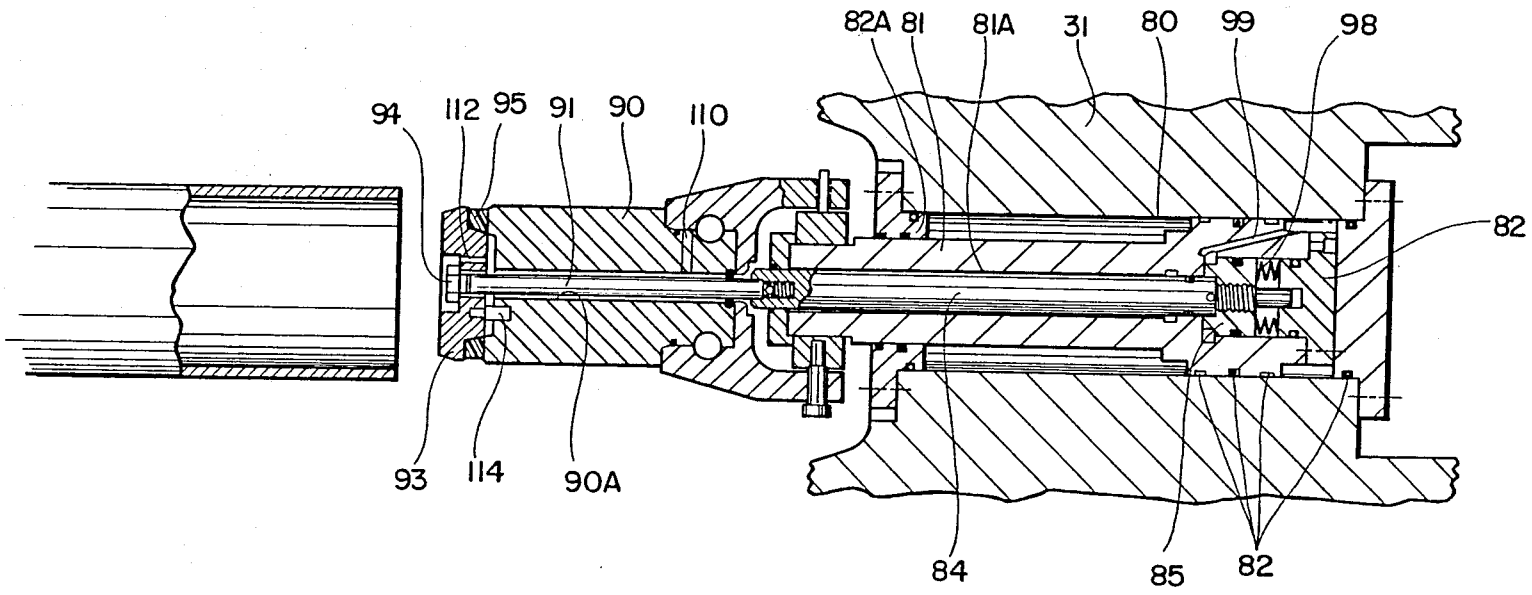
FIG. 9 is an enlarged fragmentary vertical cross section showing the mandrel in its retracted position.
Figure 10:
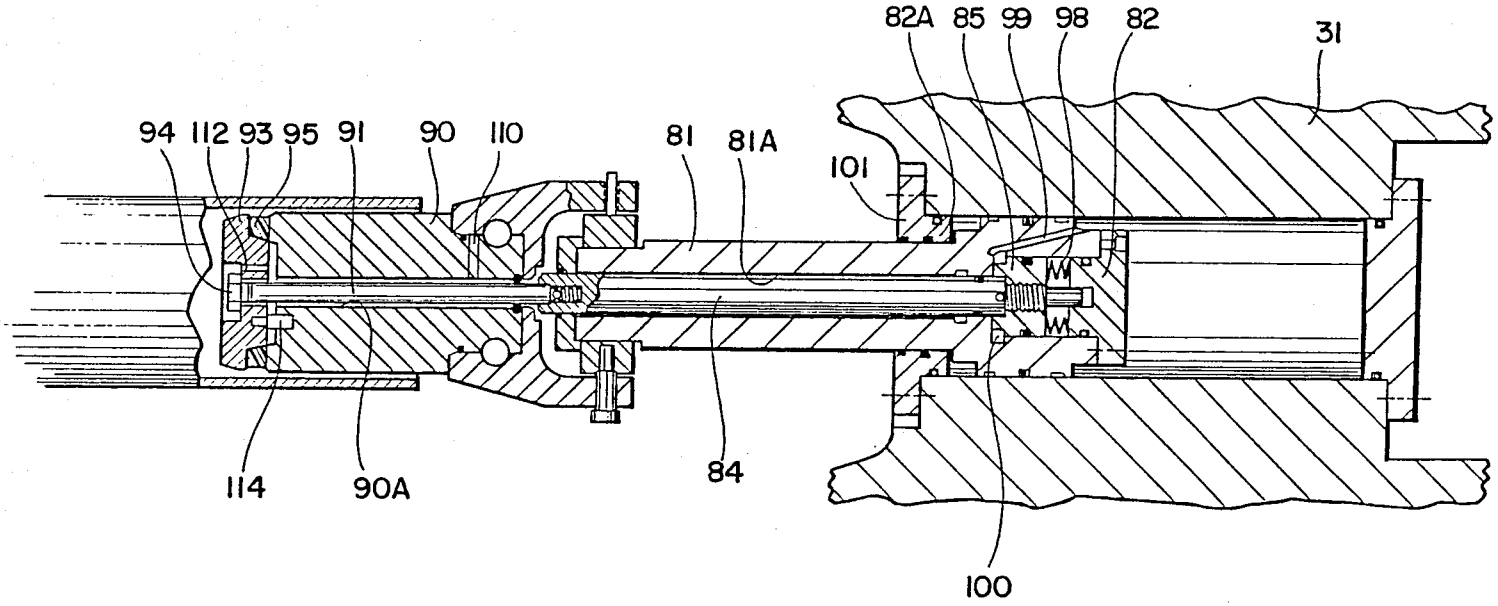
FIG. 10 is a view similar to FIG. 9 showing the mandrel in its extended position within an extrusion.
Figure 11:
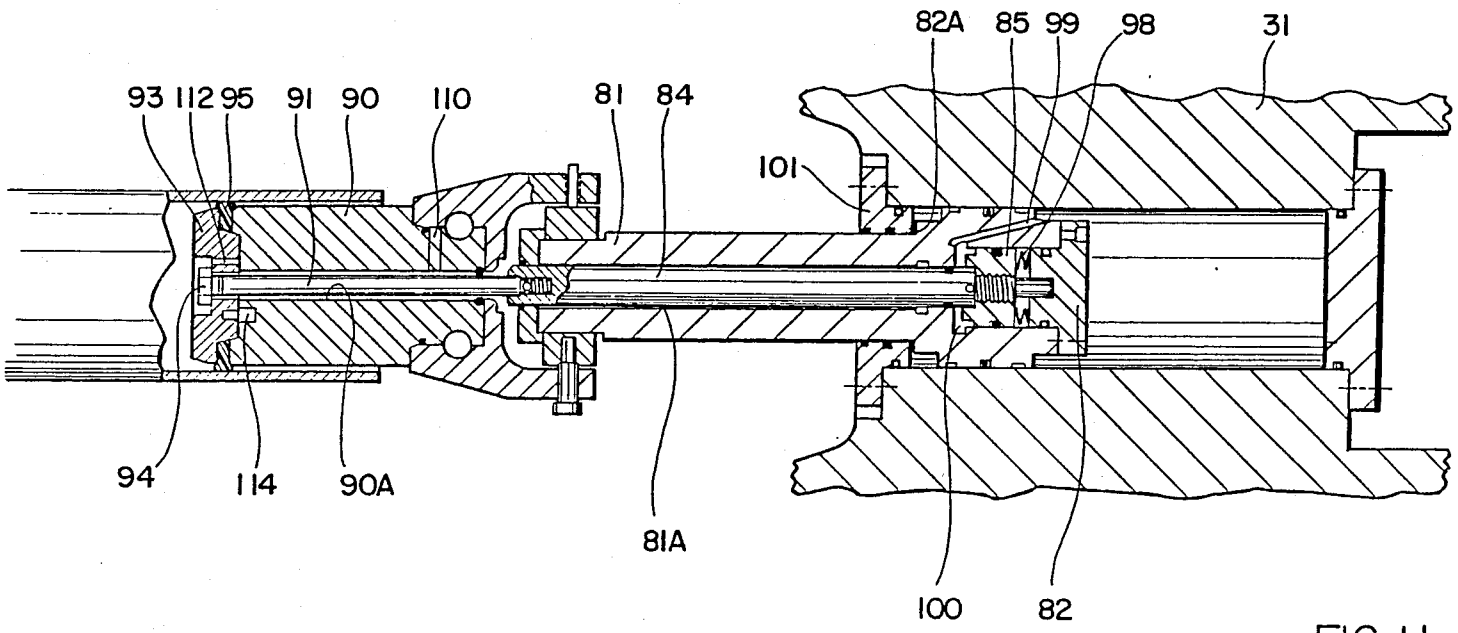
FIG. 11 is a view similar to FIG. 10 showing the mandrel in sealing relation within the extrusion.

A significant feature of the invention which permits an extrusion to be formed into much more severe bends and twists is illustrated sequentially in FIGS. 9, 10 and 11. Referring specifically to FIG. 9, the body of jaw 31 includes a through bore 80 therein, into which is slidably mounted a rod 81. A piston 82 is secured to the end of rod 81. A plurality of annular seals 82 form a pressure tight hydraulic fluid assembly.

Rod 81 includes a bore therein 81A. A rod 84 is positioned in bore 81A and has secured to the end thereof adjacent piston 82 a piston 85. A mandrel 90 is locked onto one end of rod 81 for rotation and longitudinal movement therewith. Mandrel 90 includes a through bore therein 90A into which is positioned a rod 91. One end of rod 91 is threaded into the end of rod 84 opposite piston 85. The other end of rod 91 retains a nose 93 on the outer end of mandrel 90 by means of a threaded nut 94. A urethane rubber seal 95, in the form of a doughnut-like ring is positioned in an annular recess of reduced diameter between the outer end of mandrel 90 and the inner end of mandrel nose 93 In the position shown in FIG. 9, mandrel 90 is ready to be inserted into the extrusion "E".

Referring now to FIG. 10, mandrel 90 is inserted into the extrusion by introducing fluid under pressure into the blind side of piston 82. A space is defined between the rod of piston 82 and the blind end of piston 85. A Bellville washer 98 normally urges piston 82 and 85 apart. A vent tube 99 allows hydraulic fluid communication between the blind end of piston 82 and an annular pressure chamber 100 on the rod end of piston 85. Introduction of pressure into cylinder 80 moves piston 82 forward. So long as piston 82 can move, pressure in bore 80 remains relatively low. However, piston 82 "bottoms out" when a shoulder 82A abuts against a cap 101. When this occurs, pressure in bore 80 rises. This pressure is transmitted to pressure chamber 100 through vent tube 90 which causes piston 85 to move rearwardly, compressing Bellville washer 98. The rearward movement of piston 85 carries with it rod 84 and rod 91. The rearward movement of rod 91 compresses mandrel nose 90 against urethane seal 95 causing it to expand outwardly.

As is shown in FIG. 11, the outward expansion of urethane seal 95 causes an airtight seal to be created between mandrel 91 and the interior walls of the extrusion. Once this seal has been accomplished, high pressure air is introduced into the extrusion in the following manner. Pressurized air flows through an air inlet 110 into a bore 98, which is oversized relative to rod 91 positioned therein. The air flows into a vent 112 and mandrel nose 93 and past nut 94 into the extrusion. The extrusion is therefore "inflated" in the sense that high pressure air impinging on the interior walls of the extrusion create greatly increased resistance to crimping which is ordinarily caused when tubular members are bent beyond a certain point.

An anti-rotation pin 114 and mandrel 91 and projecting into mandrel nose 93 maintains proper orientation between mandrel 91 and mandrel nose 93. When the extrusion forming process is complete, pressure is released on the blind end of piston 82. This releases pressure on the rod end of piston 85 and the Bellville washer re-expands, pushing rod 84 forward. The relaxation of the pressure by the mandrel nose against the urethane seal withdraws the urethane seal 95 away from the interior walls of the extrusion, and the air therein is allowed to escape.

Figures 1, 12:
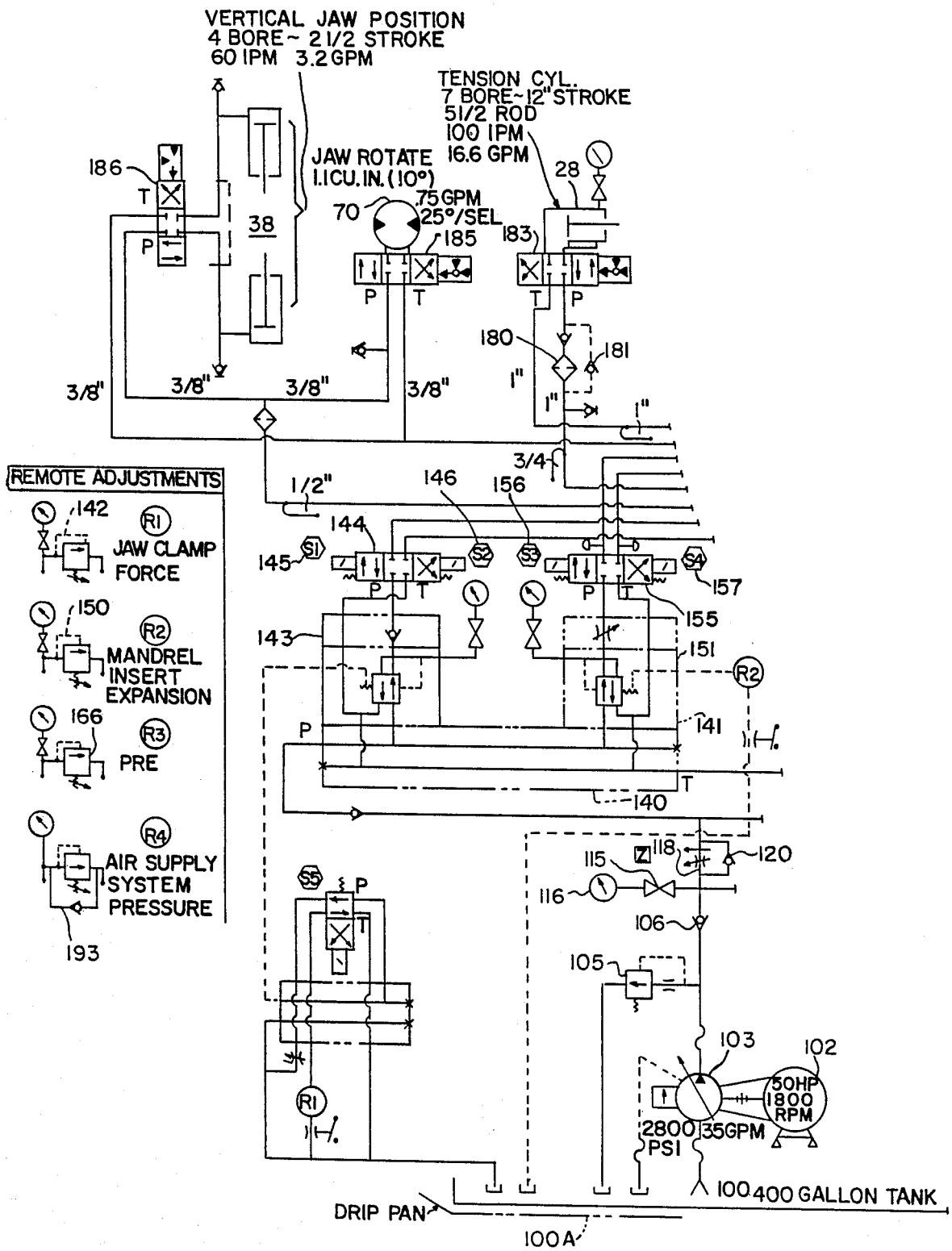
Figures 2, 12:
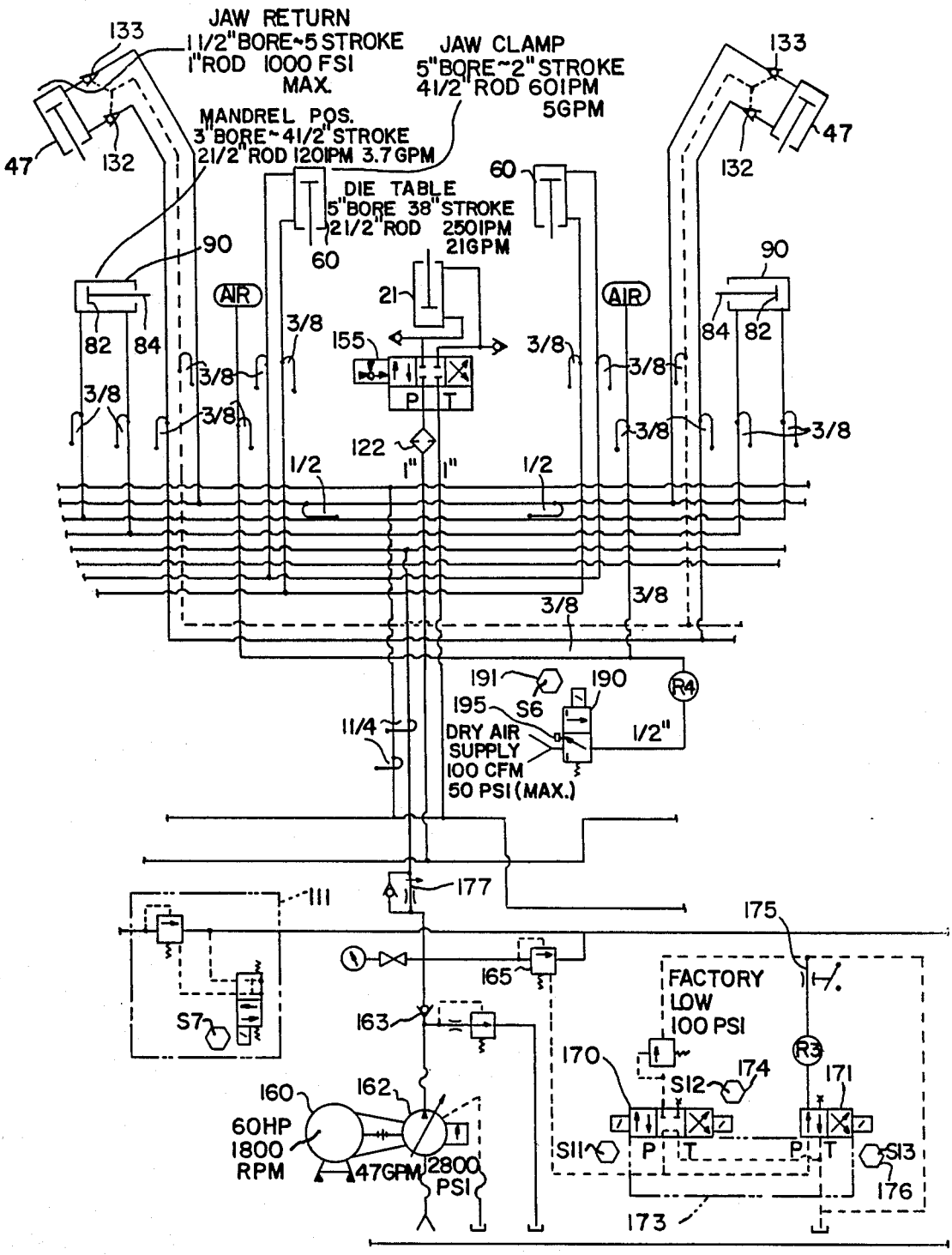
Figures 3, 12:
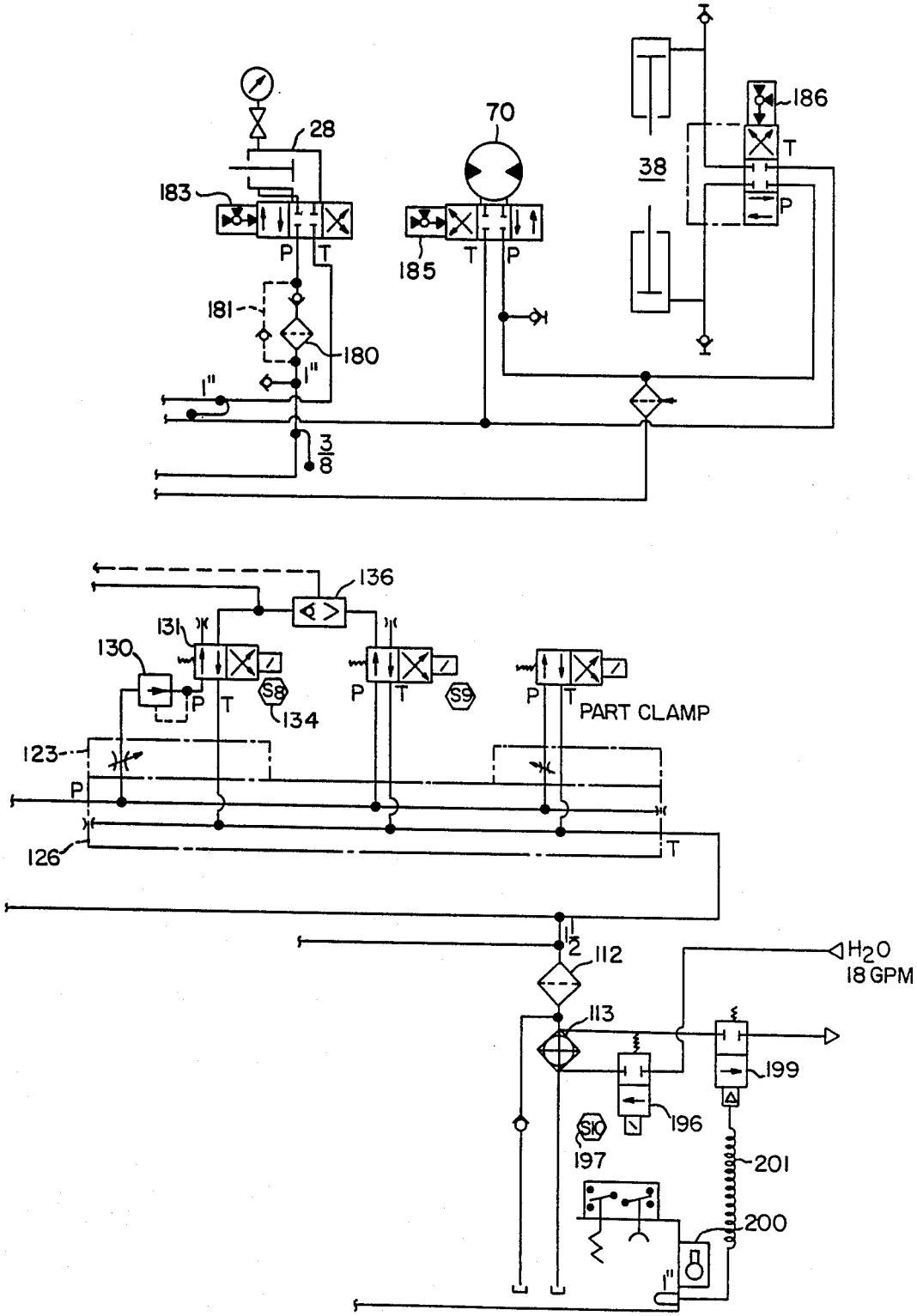

Referring now to FIG. 12, the hydraulic system of extension former 10 is described.

FIG. 12 is a detailed schematic view of the hydraulic circuit, the operation of which is straightforward in terms of standard hydraulic engineering practice. Therefore, the circuit will be described in summary fashion.

As with the above mechanical description, the following description of the hydraulic circuit refers only to a single tension cylinder 28, mandrel 90, and so forth. It is understood that the description is equally applicable to both sides of extrusion former 10.

The hydraulic circuit includes a 400 gallon (1,514 liter). reservoir 100 on which is mounted the various pumps, motors, relieving valves, manifolds and circuit operation valves. The pumps are variable volume pressure compensated type, which are "C" face mounted to the motors. The motors are mounted on vibration isolation pads, and all hydraulic lines from the pumps to the reservoir of hard piping have hose connections. By isolating the pumps and motors in this manner, vibration during operation is held to a minimum in the machine and hydraulic lines. This reduces operation noise and reduces the incidence of leaks in the system.

A Drip pan 100A is provided to prevent oil from accumulation on the floor due to spills during filling or component failure. All connections are SAE straight thread "O" ring, or four bolt "O" ring flange type.

All actuating cylinders are located on extrusion former 10 and are described above. They are also indicated by reference numerals in FIG. 12. Where possible, servo valves are mounted as an integral part of the actuators. All servo valves are protected by three micron pressure filters. All pressure gauges are provided with shut offs. All remote operator adjustments are located at the front of the machine for easy access. All hoses, pipes, tubing, manifolds, valves, and other components are designed and manufactured per NFPA and JIC standards. The hydraulic system is a 3000 lb/sq in (2,109,000 kg/sq meter) system operating at 2800 lb/sq in (1,968,400 kg/sq meter).

Pressure for the die table circuit 18 is provided by a 50 horsepower, (50.7 metric horsepower) 1800 rpm alternating current electric motor 102 driving a 35 gal/-min (132 liter/min) variable pressure compensated pump 103 set to operate at 2800 lb/sq in (1,406,00 kg/sq meter). Pump 103 has a case drain return to tank and an air bleed valve 105 which prevents air entrapment during start-up. A check valve 106 is provided to prevent back-flow through pump 103. An overpressure relief valve 107 is provided which protects the system from excessive pressure. A solenoid operated pressure dumping valve 111 is used to unload the pump 103 and circulate oil back to reservoir 100 through a return filter 112 and a heat exchanger 113. This recirculation occurs whenever power is not being supplied to the die table 18. This feature conserves electrical energy and filters and cools the oil. A shutoff and pressure gauge 115 and 116, respectively, are provided for monitoring pump pressure. A pressure compensated flow control valve 118 and a reverse free flow check valve 120 are provided for oil flow regulation and will vary the speed of die table 18.

At this point in the circuit, several other circuits branch off from pump 103. The die table 18 branch leaves the power unit and connects to extrusion former 10. Oil passes through a three micron pressure filter 122 immediately before entering a servo valve 124. One port of servo valve 124 is connected to the blind end of the die table cylinder 21. The other port of servo valve 55 is connected back to reservoir 100, passing the return oil through filter 112 and heat exchanger 113.

Pressure for the locking cylinders 47 is supplied by a manifold 126 in the pressure line. A flow control valve 128 is mounted on manifold 126 and controls movement of the tension cylinder 28. A pressure reducing valve 130 reduces system pressure to the point just sufficient to move the locking cylinder 47. A solenoid operated directional control valve 131 is shifted during the forming cycle to a "floating" mode when forming is actually taking place to a "locking" mode when the extrusion is being removed to a "return" mode when the tension cylinder 28 is returned to its starting position for another forming cycle. One of the ports of control valve 131 is blocked and the other port connected to extrusion former 10 through a check valve 132 to the rod end of locking cylinder 47.

The return from the blind end of the locking cylinder 47 is back to reservoir 100 through a check valve 133, return filter 112 and heat exchanger 113.

Valve 131 and a solenoid 134 controls pilot pressure to the check valves 132 and 133 on tension cylinder 47. If solenoid 134 is not energized, pilot pressure is supplied to check valves which are held open for free flow allowing tension cylinder 47 to move. If solenoid 134 is energized, pressure is shut off and the check valves 132 and 133 close, thereby locking the locking cylinder 47. A shuttle check valve 136 allows flow from valve 131 under the control of either solenoid 134 or 137, but not both.

Pressure to jaw clamp piston 60 is provided from pump 103 through check valve 106 to prevent back flow to a manifold 140. A remotely adjustable pressure reducing module 141 controls the fluid pressure through a pilot pressure provided by a remote pressure valve 142 which is controlled by the machine operator. A check module 143 prevents jaw clamping pressure from being bled down as a result of a downstream operation of another circuit. A double solenoid directional control valve 145 with a blocked center contains two solenoids 145 and 146. If solenoid 145 is energized, jaw clamping piston 60 will close. If solenoid 146 is energized, jaw clamping piston 60 will open. One port of valve 145 delivers pressure to the blind end of cylinder 60 while the other port returns fluid to manifold 140 and reservoir 100 through filter 112 and heat exchanger 113.

Mandrel 90 is pressurized through manifold 140 and pressure reducing module 141. Pressure on the mandrel is controlled by a remotely operated manual valve 150. A flow control module 151 is used to preset the mandrel pressure.

A double solenoid directional valve 155 with a blocked center controls the extension and retraction of mandrel 90. If a solenoid 156 is energized, mandrel 90 extends. If solenoid 157 is energized, mandrel 90 retracts. Valve 155 is pressure controlled to reduce pressure when cylinder 82 bottoms and when pressure rises due to lack of fluid flow. One port of valve 155 is connected to the blind end of mandrel 90 and another port to the rod end of mandrel 90. A tank line returns fluid to the manifold 140 and then to reservoir 100 through filter 112 and heat exchanger 113.

Pressure for the tension cylinder 28 is provided by a 60 horsepower (61 metric horsepower) alternating current electric motor 160 driving a 47 gal/min (17.8 liter/min) variable volume compensated pump 162 set at 2800 lb/sq in (1,406,000 kg/sq meter). Pump 162 has a case drain return to tank and an air bleed valve 105 which prevents air entrapment during start-up. A check valve 163 is provided to prevent back-flow through pump 162. An overpressure relief valve 165 is provided, and is set at 3000 lb/sq in (2,109,000 kg/sq meter) to prevent the system from damage due to excess pressure.

An operator adjustable pilot port 166 is provided to adjust the pull of the tension cylinder 28 in a manual operation mode. A pair of directional control valves 170 and 171 are mounted on a common manifold block 173. If solenoid 174 is energized and solenoid 176 is not energized, tension cylinder 28 can be manually operated. If solenoid 174 is energized, a low pressure of 100 lb/sq in (70,300 kg/sq meter) is achieved for snugging the extrusion to be formed into in the jaw 31. A flow switch 175 signals that the preset pressure has been reached. Downstream of valves 170 and 171 is a pressure compensated flow control valve 177 with reverse free flow which is used to adjust speed of the tension cylinder 28. A pressure filter 180 having a check 181 prevents back flushing of the filter during payout of the tension cylinder 28. A servo valve 183 is manifold mounted directly to tension cylinder 28. The tank from valve 183 returns to reservoir 100 through filter 112 and heat exchanger 113.

Rotary actuator 70 and hydraulic lifting cylinder 38 are powered by pump 103 through a rotary servo valve 185 and a vertical lift servo valve 186, respectively. Servo valve 185 is manifolded directly to rotary actuator 70. Tank lines from servo valves 185 and 186 empty into reservoir 100 through return line filter 112 and heat exchanger 113.

Air is supplied to the mandrel 90 to pressurize the extrusion through a solenoid operated valve 190. Solenoid 191 is energized to supply pressure. Pressure is controlled by a manual control 193. After formation of the extrusion is complete, solenoid 191 is de-energized and air is vented through an exhaust silencer 195.

Coolant water enters the circuit through a solenoid operated valve 196. Solenoid 197 is energized and allows water flow whenever the machine power is on. Water flows through heat exchanger 113 and to a control valve 199. Valve 199 is opened and closed by a temperature sensor 200. When oil temperature reaches a preset point, valve 199 opens and allows water to pass into the heat exchanger 113.

Low oil level and excessive oil temperature is sensed by a sensor 201. A check valve 199 provides a bypass around heat exchanger 113 should a line pressure surge take place in order to protect the heat exchanger.

The remaining details of the hydraulic circuit and related components are straightforward and clearly shown in FIG. 12.

Referring now to FIGS. 13 through 18, the sequence of operation of extrusion former 10 is illustrated.

Figure 13:
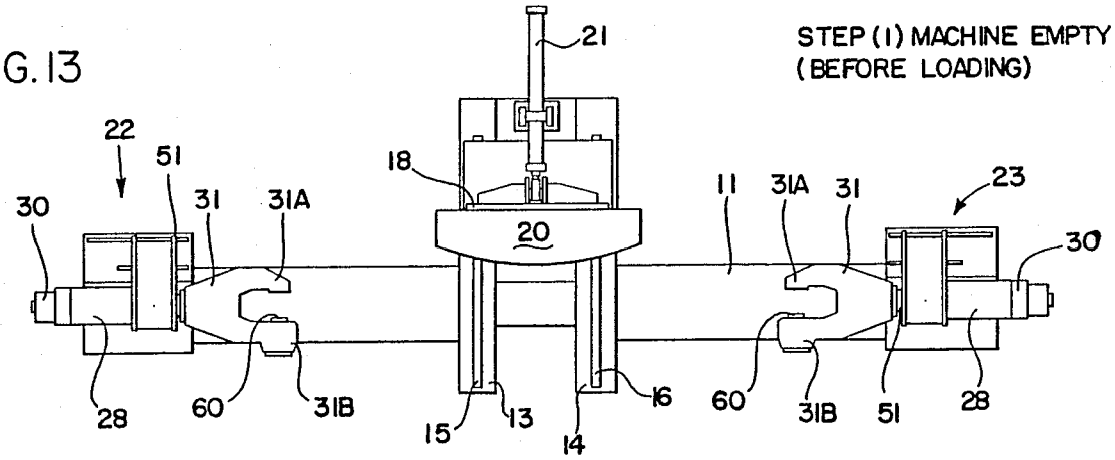
FIGS. 13 through 18 are simplified sequential views of the extrusion former in operation.

In FIG. 13, extrusion former 10 is shown in its ready, retracted position before loading with an extrusion to be formed. The type of extrusion to be formed will ordinarily be a tubular extrusion of a formable metal such as aluminum. The extrusion must be relatively airtight except through its ends.

Figure 14:
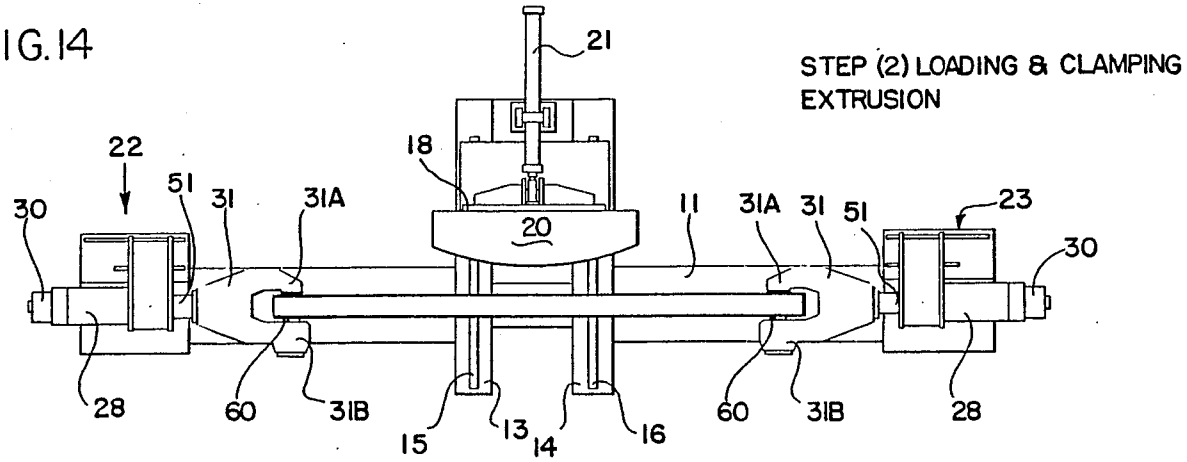

The carriages 22 and 23 are positioned on carriage ways 25 in the correct position for the length of the extrusion and locked into place. The carriages themselves do not move during the forming process. Operation of the extrusion former 10 is begun manually by activating a switch which extends the jaws 31 towards each other to the correct spacing to receive the opposite ends of the extrusion. As is shown in FIG. 14, the extrusion is clamped into jaws 31 by clamping cylinders 60, initially under only light pressure so minor adjustments in the positioning of the extrusion can be made manually by the machine operator.

The center distance between the jaws is adjustable between approximately 52 in. (132 cm) and 128 in. (325 cm) to accommodate various length sections.

The forming process takes place by control of the position into which the extrusion is placed, not the pressure exerted on the extrusion. This permits minute variations among extrusions to be automatically compensated for. When the first extrusion is formed, the extrusion former is set in a "learning" mode wherein all movements and positions of the extrusion former 10 are recorded on magnetic tape or disk. Then exact repeats of the forming process can be performed on subsequent extrusions by numerically controlling the extrusion former 10--in effect "playing back" the formation of the first extrusion as many times as desired by exactly duplicating the position of the jaws, cylinders, etc. of the machine.

Figure 15:
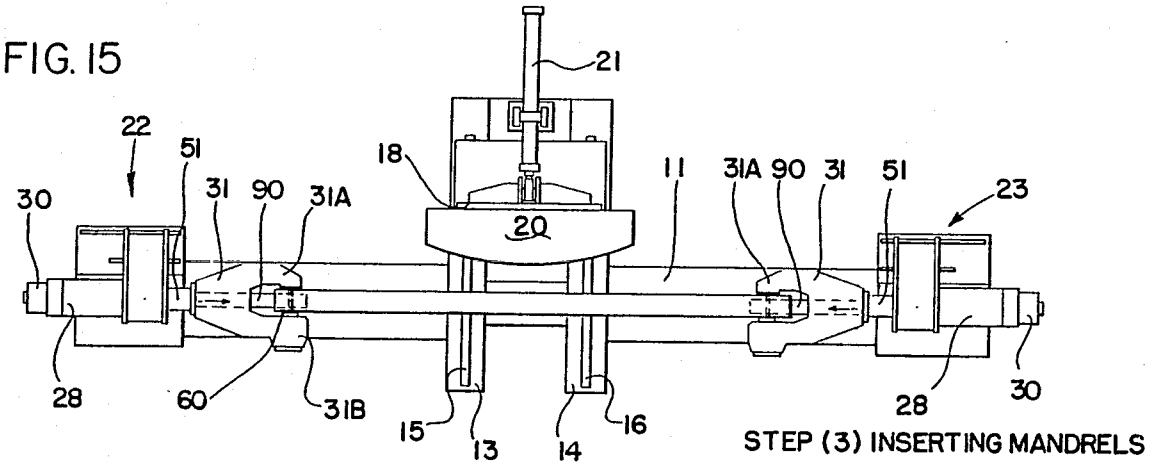
Figure 16:
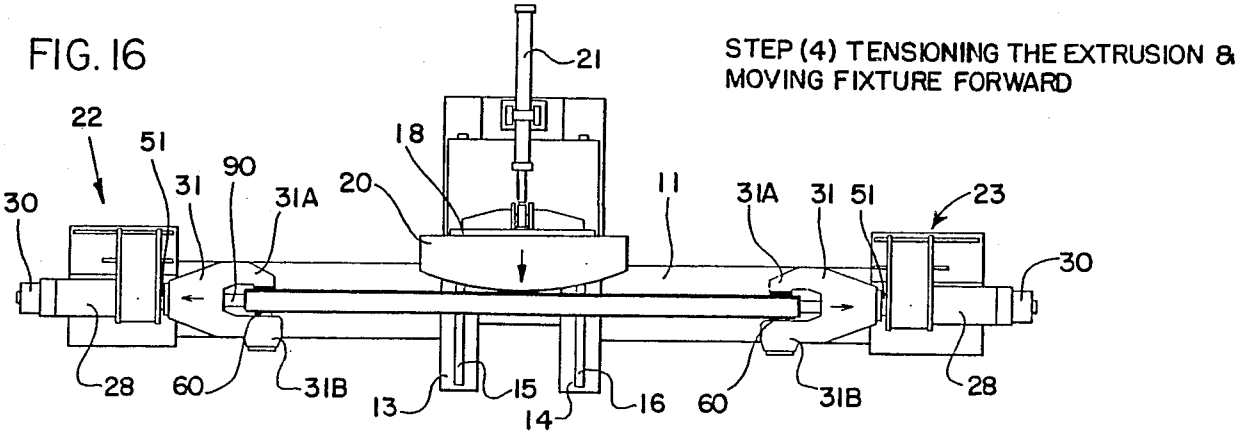

Referring once again to FIG. 14, when the extrusion is correctly positioned in the jaws 31, the automatic cycle starts. First, pressure on the extrusion by the jaw clamping cylinders 60 is increased to a low pressure setting so that the extrusion is positioned and firmly held without possibility of slippage. Then, as is shown in FIG. 15, the mandrels 90 extend into the end openings of the extrusion. The mandrels 90 are shaped in cross-section to correspond to the shape of the cross-section of the extrusion. Once properly inserted, urethane seals 95 are expanded and an airtight seal is created between the seals 95 and the interior walls of the extrusion. The pressure of clamping cylinder 60 is increased to secure the extrusion. Air is then pumped into the extrusion through air vent 112, pressurizing the extrusion and thereby adding significantly greater resistance to kinking and crimping of the extrusion. This enables a much greater degree of forming to be done more quickly than otherwise. The degree of pressurization of course depends upon the characteristics of the extrusion and the type of forming to be done and is determined essentially by empirical observation based on experience.

Tension cylinders 28 are then activated and pull on the extrusion from opposite sides at a pressure sufficient to place the crystalline structure of the extrusion into a "yield state" wherein the metal is especially susceptible to forming. Once in a proper yield state, die table 18 begins moving, (FIG. 17) driving the die 20 into contact with the central portion of the extrusion. The die 20 has a channel (not shown) formed in its leading edge which receives the extrusion and holds it in a set position. If both ends of the extrusion are to be rotated in the same direction at once, a clamp (not shown) can be placed on the side of the extrusion opposite the die 20 to prevent "rollover" of the extrusion out of the channel. Any desired combination of movements can be achieved during the extrusion process. For example, mounting blocks 35 can be independently moved up or down, thereby placing a "warp" in the extrusion at the same time as a twist is being formed by the rotation of the jaws 31. As is best shown in FIG. 5, tension cylinders 28 and jaws 31 pivot as the die 20 drives against the extrusion to maintain a correct tangency. When the forming process is complete, the swing cylinders 47 lock the tension cylinders in the precise position achieved at the completion of the forming step, preventing any movement of jaws 31 upon release of the clamping pressure on the extrusion. Binding or kinking of the extrusion in the jaws 31 is therefore eliminated, making the extrusion much easier for the machine operator to remove.

After the formed extrusion is removed, urethane seal 95 is retracted form sealing engagement with the extrusion, allowing air pressure in the extrusion to return to atmospheric pressure. Mandrels 90 are retracted from the extrusion and clamping pressure on the extrusion is released, allowing the machine operator to remove the formed extrusion. Then swing cylinders 47 activate and return the tension cylinders to their loading position, as shown in FIG. 13.

Figure 17:
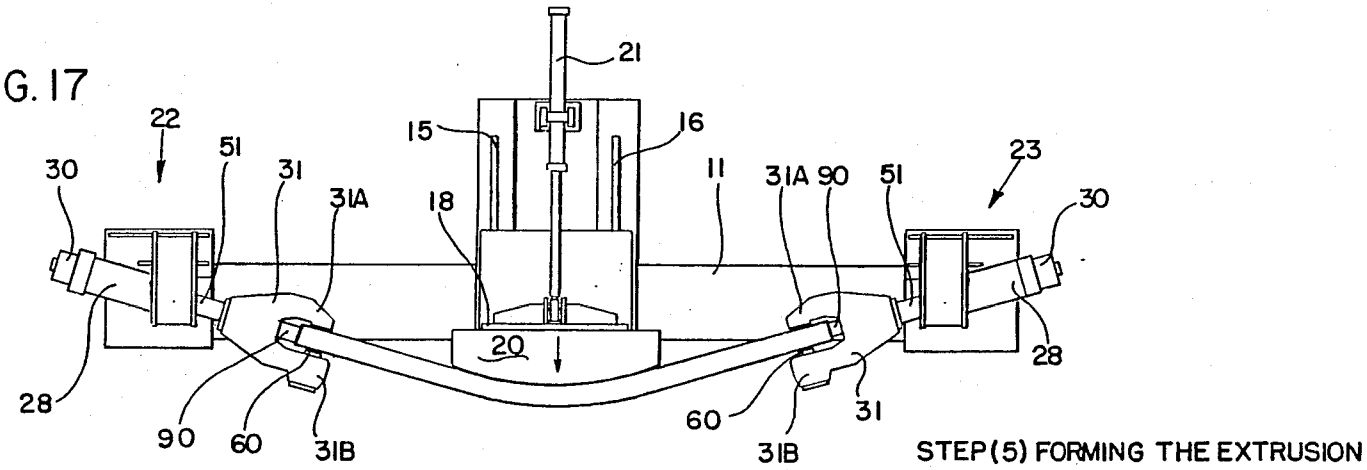
Figure 18:
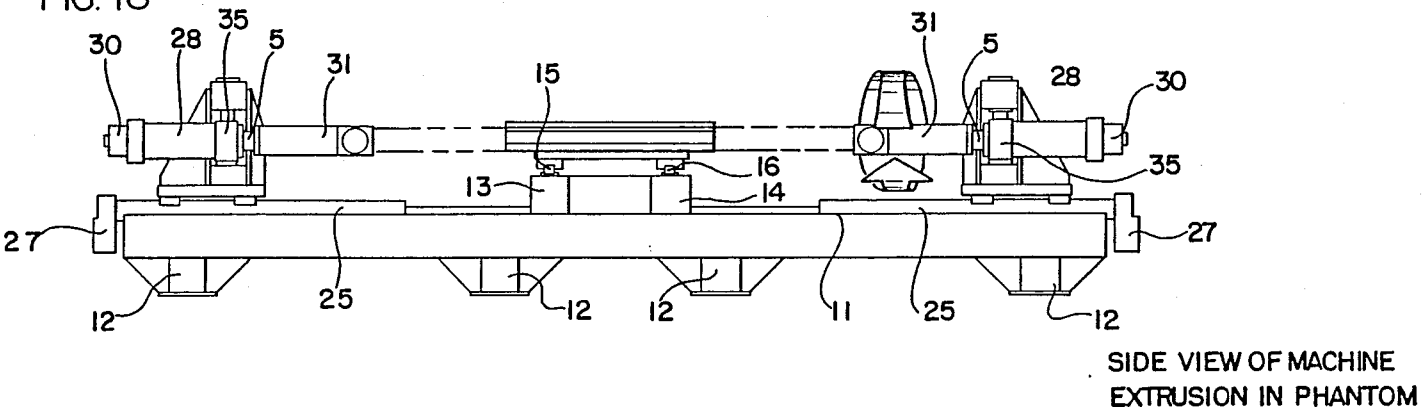
Figure 20:
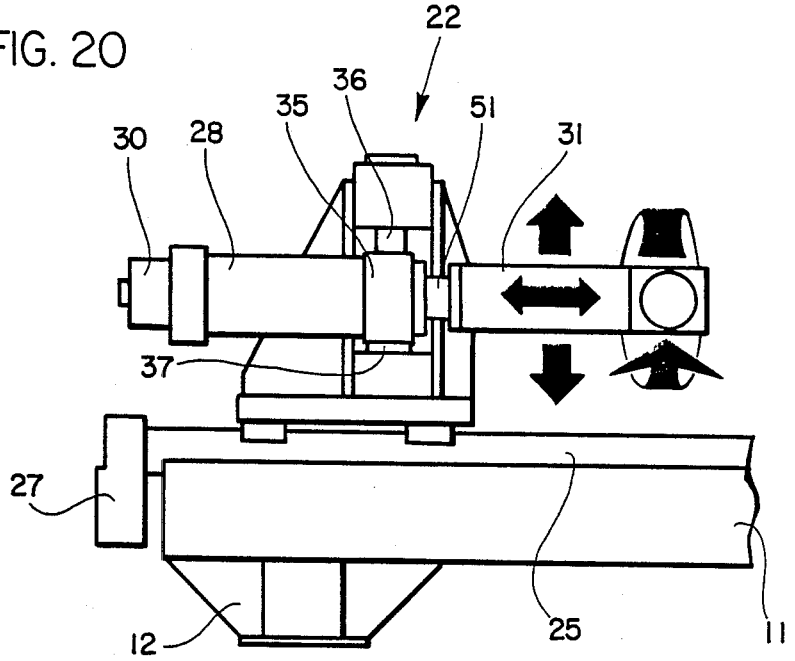
FIG. 20 is a fragmentary side elevation of the carriage showing the various movements of the jaw of the extrusion former.
Figure 19:
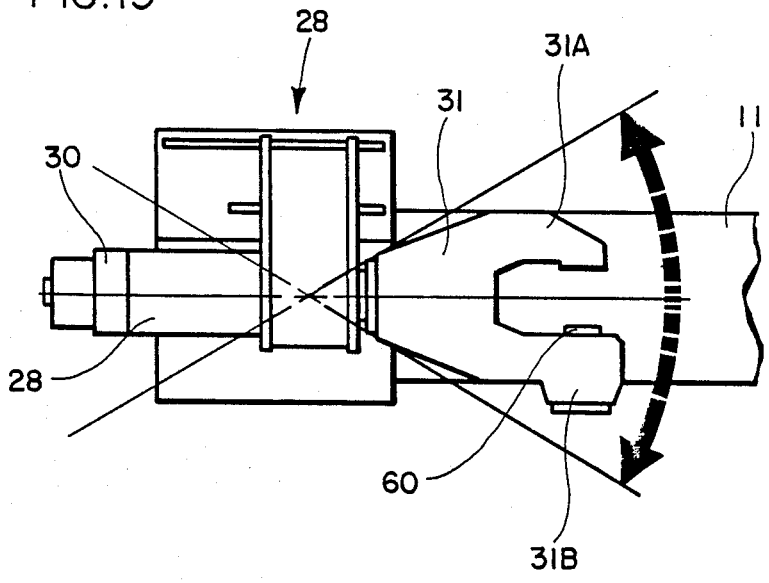
FIG. 19 is a fragmentary top plan view of the carriage showing the vertical axis of movement of the tension cylinder.

FIG. 18 illustrates the step shown in FIG. 17, but in a side elevation view. FIGS. 19 and 20 summarize the various movements of which extrusion former 10 is capable.

An extrusion former is described above. Various details of the invention may be changed without departing from its scope. Furthermore, the foregoing description of the preferred embodiment of an extrusion former according to the present invention is provided for the purpose of illustration and not for the purpose of limitation--the invention being defined by the claims.

I claim:

1. A former for bending an elongate member characterized by a three-way powered forming movement and comprising:

(a) a main frame;

(b) a moveable die table mounted on said main frame for carrying a die which is to be urged against the member to form a predetermined shape;

(c) carriage ways carried on said main frame and aligned along a longitudinal axis;

(d) first and second carriages mounted on said carriage ways in spaced-apart relation on opposing sides of said die table;

(e) member holding means carried by each of said first and second carriages for holding opposite ends of said member;

(f) tensioning means carried by each of said first and second carriages for urging said member holding means in opposite directions parallel to said longitudinal axis to place the member being formed under a predetermined tension;

(g) rotation means carried by each of said first and second carriages for applying a twisting forming movement to said member about an axis parallel to said longitudinal axis;

(h) movement means carried by each of said first and second carriages for moving said member holding means in opposing directions perpendicular to the direction of tension application on the member for applying a nontwisting bend to the member; and (i) control means operationally connected to and controlling the movement of the tensioning means, rotation means and movement means to achieve a member conforming to a predetermined configuration.

2. An elongate member former according to claim 1, wherein said control means includes means for forming the member by the shape of the member in relation to the position of the die, the rotation means and the vertical movement means during the forming process.

* * * * *